US006899221B2

(12) United States Patent
Skolik et al.

(10) Patent No.: US 6,899,221 B2
(45) Date of Patent: May 31, 2005

(54) BOTTLE CARRIER

(75) Inventors: Bernard Skolik, Bassum (DE); Jens Eckermann, Bremen (DE); Hilger Scheelcke, Bremen (DE)

(73) Assignee: A & R Carton GmbH, Kriftel (DE)

( * ) Notice: Subject to any disclaimer, the term of this patent is extended or adjusted under 35 U.S.C. 154(b) by 198 days.

(21) Appl. No.: 10/174,796

(22) Filed: Jun. 18, 2002

(65) Prior Publication Data

US 2003/0006158 A1 Jan. 9, 2003

(30) Foreign Application Priority Data

Jul. 6, 2001 (DE) ..... 201 12 228 U

(51) Int. Cl.[7] ..... B65D 75/00

(52) U.S. Cl. ..... 206/141; 206/427; 206/428; 229/117.13; 229/117.14

(58) Field of Search ..... 206/141, 142, 206/143, 162, 427, 428; 229/117.12, 117.13, 117.14

(56) References Cited

U.S. PATENT DOCUMENTS 5,297,725 A * 3/1994 Sutherland ..... 229/117.13
5,385,234 A * 1/1995 Stout et al. ..... 206/427
5,395,044 A * 3/1995 Stout ..... 229/117.13
5,639,017 A 6/1997 Fogle ..... 229/117.14
5,794,778 A * 8/1998 Harris ..... 206/428
5,915,546 A 6/1999 Harrelson ..... 206/200
6,065,590 A 5/2000 Spivey ..... 206/141

FOREIGN PATENT DOCUMENTS

WO 96/35624 11/1996
WO 99/28207 6/1999

* cited by examiner

*Primary Examiner*—David T. Fidei
(74) *Attorney, Agent, or Firm*—Vidas, Arrett & Steinkraus, P.A.

(57) ABSTRACT

A bottle carrier made of a foldable flat material, particularly cardboard, comprising a top wall, a bottom wall, side walls interconnecting the top wall and bottom wall at the sides, and a handle portion extending across the top wall and into two opposed side walls which is defined by weakening lines in the top wall and the side walls, has a strip-shaped central portion in the top wall and two fork-shaped end portions each of which extends into an adjoining side wall from the top wall and is joined to the side wall at the outer ends.

27 Claims, 6 Drawing Sheets

BOTTLE CARRIER

CROSS-REFERENCE TO RELATED APPLICATIONS

Not applicable.

STATEMENT REGARDING FEDERALLY SPONSORED RESEARCH

Not applicable.

BACKGROUND OF INVENTION

The invention relates to a bottle carrier made of a foldable flat material, particularly cardboard.

Bottle carriers made of cardboard in the shape of a box enclosing a set of bottles on all sides have been known already. It is further known, that such bottle carriers, in a top wall, have two adjoining punched-out portions into which a hand may be inserted to carry the bottle carrier by a strip-shaped handle defined between the punched-out portions. If such a bottle carrier is used there is a disadvantage that the hand might readily touch the bottle top regions where crown caps are. Furthermore a strong cardboard material has to be employed to prevent the handle from rupture because of the considerable forces that act while it is being carried.

U.S. Pat. No. 6,065,590 discloses an article carrier the top wall of which have a handle strip the ends of which extend into the end walls. The handle strip is adapted to be raised beyond the top wall with raising being made difficult by a top wall flap remaining below the handle strip. In addition, the raising path is limited by the fact that the handle strip will come to lie against the top areas of the articles in the vicinity of the end walls. A two-layered structure of the handle strip is achieved by a reinforcing strip folded below the strip. This involves relatively great technical expenditure in manufacture and leads to local material accumulations which can be a disturbance in storing the pre-glued cut-to-size pieces.

A similar construction is shown in WO 99/28207 A1. However, the handle portion is not reinforced here.

U.S. Pat. Nos. 5,639,017 and 5,915,546 relate to article carriers with multi-layered handle strips made of superposed flaps of a top wall. The handle strips extend into the end walls and are designed to be raised beyond the top walls. The raising path is limited by the fact that the handle strips will come to lie against the top areas of the end-side articles.

Accordingly, it is the object of the invention to provide a bottle carrier which exhibits more favourable handling characteristics and has a sufficiently strong handle portion.

BRIEF SUMMARY OF THE INVENTION

The inventive bottle carrier made of a foldable flat material, particularly cardboard, has

- a top wall,
- a bottom wall,
- side walls interconnecting the top wall and bottom wall at the sides, and
- a handle portion extending across the top wall and into two opposed side walls which is defined by weakening lines in the top wall and the side walls, has a strip-shaped central portion in the top wall and two fork-shaped end portions each of which extends into an adjoining side wall from the top wall and is joined to the side wall at the outer ends.

The fact that the fork-shaped end portions extend into the adjoining side walls from the top wall causes the fork-shaped end portions to be slightly drawn in some areas into the bottle carrier when the strip-shaped central portion is raised. This enables the fork-shaped end portions to penetrate their fork prongs into the vacant spaces next to the necks of bottles, particularly in between the necks of adjoining bottles. This makes it possible to raise the strip-shaped central portion particularly distant from the bottles so that the gripping of the strip-shaped central portion bottles will be less disturbed by the bottles. What adds to this is that joining the ends of the fork-shaped end portions to the side walls allows to favourably introduce weighting forces into the handle portion and makes it possible to manage with a cardboard material which is less thick than that of conventional bottle carriers in which the handle strip has joined its ends to the top wall. This allows to employ a cardboard material having a smaller grammage or being of a less strong quality, and to save cost and weight.

In an aspect, the fork-shaped end portions each have two fork prongs which may penetrate, for instance, into the vacant spaces on either side of a bottle with the gap between the fork prongs receiving the neck of said bottle. This design is suited for a bottle carrier which has several parallel rows each containing an odd number of bottles in a direction transverse to the handle portion. In practice, bottle carriers having three bottles in each row are widely in use.

In another aspect, the fork-shaped end portions each have three fork prongs which may penetrate, for instance, into the vacant spaces on either side of two bottles with the gaps between the three fork prongs receiving the necks of said bottle. This design is suited for a bottle carriers which have parallel rows each containing an even number of bottles in a direction transverse to the handle portion. An example are bottle carriers having four bottles in each row.

Generally, the fork-shaped end portions may also have more than three fork prongs.

According to an aspect, the weakening lines externally defining the handle portion in the side walls end in filletings bent away from the handle portion. This improves the transfer of forces between the ends of the handle portion and the side walls and reduces the risk that the ends will be torn off.

According to an aspect, the top wall has disposed thereunder a further top wall which has a further strip-shaped central portion defined by weakening lines which is disposed below the strip-shaped central portion of the top wall so that the strip-shaped central portion and the further strip-shaped central portion are adapted to be raised together. It is preferred that the two central portions are formed substantially in congruence. The further strip-shaped central portion causes the material to double in the handle area of the handle portion, which reduces the risk that the handle will tear and allows to comfortably hold the handle.

According to a further aspect, the further strip-shaped central portion is completely defined by a weakening line and is joined to the strip-shaped central portion. When the handle portion is raised the further strip-shaped central portion will be severed out of the further top wall and reinforce the handle portion. In the area of the fork-shaped end portions, the load is distributed to the several fork prongs so that a reinforcement of the handle portion is less significant there.

To grip the handle portion more conveniently, according to an aspect, punched-out apertures to insert a hand are located on either side of the strip-shaped central portion and/or the further strip-shaped central portion. The user may conveniently insert his hands into the punched-out apertures and, after gripping around the strip-shaped central portion or further strip-shaped central portion, can comfortably raise it.

According to an aspect, the strip-shaped central portion and/or the further strip-shaped central portion have tabs disposed alongside in the handle apertures which are adapted to be folded under the strip-shaped central portion and/or the further strip-shaped central portion. The tabs allow to achieve a further reinforcement of the handle portion and improve the comfort in carrying.

According to an aspect, the further top wall, at opposed sides, has hinged thereto side flaps which are disposed at the insides of the side walls to which the fork-shaped end portions are joined at their end sides.

According to an aspect, the further top wall and/or the side flaps, adjacent to the borders of the further top wall that adjoin the side walls to which the fork-shaped end portions are joined at their end sides, have disposed therein reversing flaps defined by weakening lines which are disposed below the fork prongs so that if the central portion is raised the fork prongs are reversed by the reversing flaps in an approximately curved fashion. The curved reversal helps achieve a favourable transfer of forces in the area of the fork-shaped end portions and protect them against being damaged by the upper end areas of the bottles.

According to a further aspect, at least the reversing flaps disposed in the further top wall have at least one channelled line oriented transversely to the fork prongs. In particular, this helps achieve that the reversing flaps be smoothly bent and adjoining reversing flaps may escape each other in the further top wall and the side flaps while being deformed by the fork-shaped end portions.

According to an aspect, reversing flaps disposed in the further top wall are tapered towards the side flaps, e.g. like arrow tips. The taper has the advantage that the reversing flaps will not block the bottles from being pushed in through the opened side walls. If the reversing tabs somewhat protrude into the container the upper bottle ends or bottle caps will move along the tapered sides, thereby raising the reversing tabs so that these evade the bottles.

According to an aspect, the further strip-shaped central portion has two further fork-shaped end portions each of which extends into the adjoining side flap from the further top wall and is joined to the side flap at the outer ends. This makes it possible to reinforce the whole handle portion of the top wall. When the handle portion is raised the fork-shaped end portions, along with the further fork-shaped end portions, are drawn into the vacant spaces between the bottles and laterally from the bottles. Both the fork-shaped end portions and further fork-shaped end portions may have two, three or even more fork prongs.

Intermediate tabs will remain between the fork-shaped end portions and further intermediate tabs will remain between the further fork-shaped end portions and might move out of the plane of the top wall after the handle portion is raised. To prevent this, according to a further aspect, the further intermediate tabs have a widened portion within the further top wall that could be formed like a mushroom head, for instance. Additionally, the further intermediate tabs are joined to the intermediate tabs, particularly by glueing. If the handle portion is raised areas of the further fork prongs are drawn over the widened portion, retaining the further intermediate tabs and, hence, also the intermediate tabs in the top wall and on the upper sides of the bottles.

In a bottle carrier which has rows each containing an even number of bottles in a direction transverse to the handle portion the handle portion, when raised, may engage a middle fork prong of its fork-shaped end portions with the spacing area between the middle bottles of the two outer rows. At this stage, according to an aspect, the further strip-shaped central portion has strip-shaped end portions each of which extends into the adjoining side flap from the further top wall and is joined to the side flap at the outer end. If the further strip-shaped central portion also has further fork-shaped end portions the strip-shaped end portions are middle fork prongs of the further fork-shaped end portions.

According to a further aspect, the top wall and the further top wall are connected to each other. Preferably, the strip-shaped central portion and the further strip-shaped central portion are joined to each other. Further preferably, the top wall and the further top wall are joined to each other in more areas. Preferably, they are not joined to each other in the areas of the reversing flaps and the fork-shaped end portions in order not to interfere with a relative movement of the fork-shaped end portions to the further top wall. Accordingly, it is preferred that reversing flaps in the side flaps be not joined either to the adjoining side flaps. Incidentally, the side flaps may be joined to the side walls. The side flaps, however, may also be with no connection to the adjoining side walls altogether.

The connections are preferably glued joints. They may be planar, punctiform or line-shaped or may be made in any other design adapted to be regarded by a person skilled in the art. This applies to all of the connections possessed by the bottle carrier.

According to an aspect, pull-up tabs which are defined by weakening lines and are extended approximately up to the top wall are located in two opposed side walls. Opening the pull-up tabs makes it possible to expose apertures for taking the bottles out. Since the pull-up tabs can be opened approximately like double-wing doors the top wall will not be damaged so that the handle portion is maintained, in particular. Therefore, the bottle carrier is also suited for use in carrying back the emptied bottles.

According to an aspect, each pull-up tab has a hinged joint in the vicinity of the top wall and is defined by two approximately weakening lines led away approximately in parallel from the hinged joint which are joined to each other at a spacing from the top wall. According to a further aspect, the weakening lines defining the pull-up tabs may meet together at a deep point of the pull-up tabs that forms a short gripping tab. Tearing open the gripping tabs allows to open the pull-up tabs. Furthermore, the gripping tabs may form some sort of interlocking to reclose the pull-up tabs.

It is preferred that the pull-up tabs be disposed in the side walls arranged on the longitudinal sides of the handle portion so that the pull-up tabs will not interfere with the mountings of the ends of handle portions in the side walls disposed transversely to the handle portion.

According to an aspect, upper pull-up tabs which are defined by weakening lines on either side of the handle portion and are extended up to borders of the side walls and the side flaps are located in the top wall, the side walls to which the fork-shaped end portions are joined, the further top wall, and the side flaps. Tearing open the upper pull-up tabs, preferably starting from punched-out portions next to the handle portion, makes it possible to open the top wall in order to remove bottles at the top of the bottle carrier and to re-insert them later. Likewise, it is possible to combine the upper pull-up tabs with pull-up tabs in the side walls in order to expose large upper and lateral apertures to pass the bottles therethrough.

The bottle carrier may be manufactured from a cut-to-size piece or several pieces of a foldable flat material. Preferably, it comprises a cut-to-size piece of a foldable flat material that has a bottom wall, side walls hinged to the longitudinal sides of the bottom wall, a top wall hinged to a further longitudinal side of a side wall, and a further top wall hinged to a further longitudinal side of a further side wall. This bottle carrier may be enveloped around a set of bottles or a set of bottles is adapted to be pushed in through a front-sided aperture of the bottle carrier preglued to an envelope.

According to an aspect, the bottom wall and the top wall have side wall elements hinged to the transverse sides that can be folded towards each other and are connected to each other. In particular, this allows to manufacture the bottle carrier from an integrally cut-to-size piece of a foldable material.

According to an aspect, the side wall elements have folded thereunder side wall flaps which are hinged to the transverse sides of adjoining side walls. This closes the corners between the side walls and enhances the stability of the bottle carrier. According to a further aspect, the side wall flaps are joined to the side wall elements.

According to an aspect, at least two opposed side walls have a rectangular portion adjoining the bottom wall and one trapezoidal portion adjoining the top wall, which helps achieve an accommodation of the bottle carrier to the substantially cylindrical lower areas and substantially conical upper areas of the bottles.

According to an aspect, gripping holes are disposed in at least two opposed side walls. The gripping holes help the user in seizing the bottle carrier by two hands. This can be desirable, in particular, for container carriers having a large number of bottles (e.g. four times five bottles). According to a further aspect, the gripping holes are disposed in the side walls to which the fork-shaped end portions are joined at the end sides. Advantageously, the gripping holes are disposed in the narrow sides of the container carrier, which may facilitate carrying. According to a further aspect, the gripping holes are reinforced by the side flaps, e.g. by making the side flaps end at the upper borders of the gripping holes or by providing the side flaps with complementarily formed gripping holes. This prevents the bottle carrier, while being carried, from beginning to break in the area of the gripping holes. Furthermore, it is more agreeable to carry the bottle carrier by the gripping holes. For the same reasons, according to a further aspect, gripping tabs are disposed in the gripping holes that can be folded out for carrying or can be folded in.

BRIEF DESCRIPTION OF THE SEVERAL VIEWS OF THE DRAWINGS

The invention will now be explained in more detail below with reference to the accompanying drawings of five embodiments. In the drawings.

In the description for various embodiments that follows, corresponding constructional components are provided with the same reference numbers, but with different aspects being marked by indexes.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
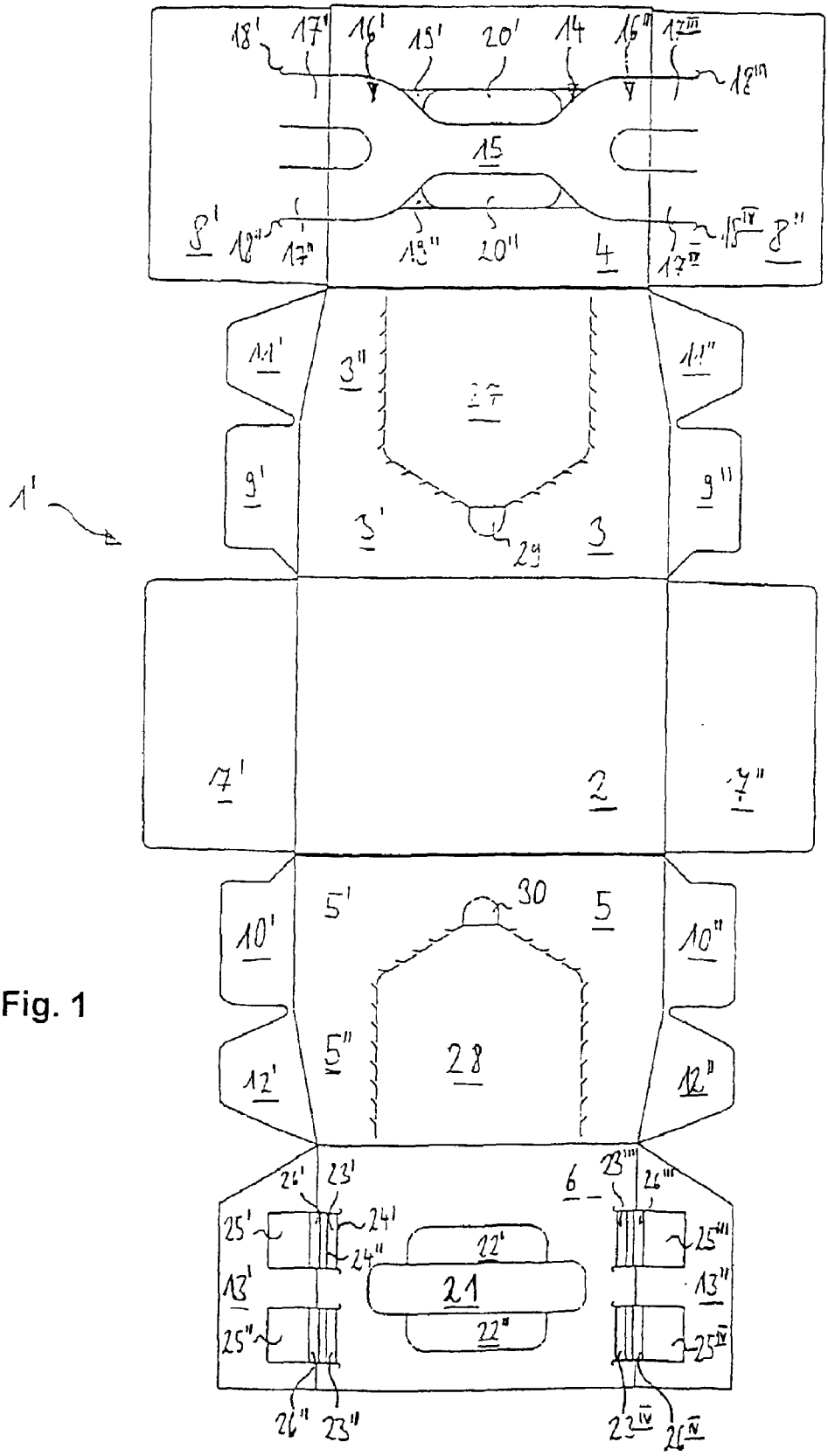
FIG. 1 shows a cut-to-size piece for a bottle carrier having a completely severable further middle portion and pull-up tabs as flatly spread out in the side walls in a plan view.

The cut-to-size piece 1' of FIG. 1 has a bottom wall 2, a side wall 3 hinged to a longitudinal side of bottom wall 2, a side wall 5 hinged to another longitudinal side of bottom wall 2 and a top wall 6 hinged to another longitudinal side of side wall 5.

Side walls 3, 5 each have a lower side wall portion 3', 5' in the shape of a rectangle and an upper side wall portion 3", 5" in the shape of a trapezoid. Bottom wall 2, top wall 4, and further top wall 6 are rectangular with top wall 4 and further top wall 6 being of a slightly smaller longitudinal extension than is bottom wall 2.

The two transverse sides of bottom wall 2 have hinged thereto approximately rectangular bottom wall elements 7', 7".

The transverse sides of top wall 4 have hinged thereto upper side wall elements 8', 8" which also are approximately rectangular.

The transverse sides of rectangular portions 3', 5' of side walls 3, 5 have hinged thereto lower side wall flaps 9', 9", 10', 10" which are of a substantially rectangular shape each.

The transverse sides of trapezoidal portions 3", 5" of side walls 3, 5 have hinged thereto upper side wall flaps 11', 11", 12', 12" which are of a substantially trapezoidal shape each.

The transverse sides of the further top wall 6 have hinged thereto side flaps 13', 13" which are of an approximately trapezoidal shape.

Top wall 4 and side wall elements 8', 8" have defined therein a handle portion 14 by punched lines. It has a strip-shaped central portion 15 which is completely disposed in top wall 4. Further, handle portion 14 has fork-shaped end portions 16', 16" which extend each in top wall 4 and a side wall element 8', 8".

Fork-shaped end portions 16', 16" each have two prongs 17', 17" and 17''', $17^{IV}$, respectively which extend in top wall 4 and into one of the two side wall elements 8', 8". Fork-shaped end portions 16', 16" end in the side wall elements 8', 8" not very distant from their hinging point at top wall 4.

The outer punched lines which define handle portion 4 end in filletings 18', 18", 18''', $18^{IV}$ bent away from handle portion 14 in side wall elements 8', 8".

Top wall 4 has punched-out portions 19', 19", which are approximately tray-shaped, on either side of strip-shaped central portion 15. Punched-out portions 19', 19" are apertures to place hands in. Punched-out portions 19', 19" have tabs 20', 20" hinged to the longitudinal sides of strip-shaped central portion 15 which are separated by weakening lines from the remaining top wall 4.

The further top wall 6 has a further strip-shaped central portion 21 defined by a circumferential weakening line which runs in the longitudinal direction of the further top wall 6. The two longitudinal sides of the further strip-shaped central portion 21, in the further top wall, have prepared thereon approximately rectangular tabs 22', 22" which can be pressed in by hand, which exposes further apertures to place hands in which are approximately in congruence with the punched-out portions 19', 19" and, for simplicity, are also designated as 22', 22".

The further top wall 6 has located therein four reversing tabs 23', 23", 23'", $\mathbf{23}^{IV}$ which are oriented lengthwise and extend to the transverse sides of the further top wall 6. Those have two transversely oriented channelled lines 24' 24".

Further, each side flap 13', 13" has located therein two reversing tabs 25', 25", 25'", $\mathbf{25}^{IV}$ which also are transversely oriented and extend to the hinged joints of side flaps 13', 13" on the further top wall 6. Each of the reversing tabs 25', 25", 25'", $\mathbf{25}_{IV}$ is oriented to an adjoining reversing tab 23', 23", 23'", $\mathbf{23}^{IV}$ with a slot-shaped punched-out portion 26', 26", 26'", $\mathbf{26}^{IV}$ being therebetween.

Side walls 3, 5 have located therein pull-up tabs 27, 28 which are defined by weakening lines. Pull-up tabs 27, 28 extend downwards from the hinged joint on top wall 4 and further top wall and have a short tongue-shaped gripping tab 29, 30 at the lower end.

A bottle carrier may be manufactured from this cut-to-size piece 1' and be filled with bottles as follows:

The cut-to-size piece 1' may be enveloped around a set of three times four bottles with top wall 4 being placed on top of further top wall 6 and top wall 4 and further top wall 6 being glued to each other in the area of the strip-shaped central portion 15 and the further strip-shaped central portion 21 disposed underneath as well as outside the handle portion 14 and the reversing tabs 23', 23", 23'", $\mathbf{23}^{IV}$ disposed under the fork prongs 17', 17", 17'", $\mathbf{17}_{IV}$.

Glueing can be done even before, in which case the set of bottles can be introduced subsequently into the cut-to-size piece 1', which has been brought into an envelope shape, through the front-sided aperture.

The bottles will seat their bottoms on the bottom wall 2 and orient their mouths onto top wall 4.

Subsequently, all of the side wall flaps 9', 9", 10', 10", 11', 11", 12', 12" are folded into the front-sided apertures.

Finally, the side wall elements 7', 7", 8', 8" are also folded into the front-sided apertures and are glued to each other and to the side wall flaps 9', 9" to 12', 12". This will form further side walls.

This completes the bottle carrier which is then ready to be stored and carried. To carry it, the user presses the fingers of one hand against the tabs 20', 20" and 22', 22", forcing them downwards until they fold under the (further) strip-shaped central portions 15, 21. Then, he pulls the (further) strip-shaped central portions 15, 21 upwards. As a result, fork prongs 17' to $\mathbf{17}^{IV}$ are slightly drawn into the inner volume of the bottle carrier, which causes them to enter the vacant spaces between the upper areas of adjoining bottles. Three bottles each are arranged on the transverse sides of the bottle carrier with each middle bottle gripping in between the prongs 17', 17" and 17'", $\mathbf{17}^{IV}$ of a fork-shaped end portion 16', 16" and the outer bottles being placed each at the outer surfaces of fork prongs 17' to $\mathbf{17}_{IV}$.

The deformation of the fork-shaped end portion 16', 16" is limited by the reversing tabs 23' to $\mathbf{23}^{IV}$ and 25' to $\mathbf{25}^{IV}$, which force the fork prongs 17' to $\mathbf{17}^{IV}$ onto an approximately curved path. At this point, the adjoining reversing tabs 23' to $\mathbf{23}^{IV}$ and 25' to $\mathbf{25}^{IV}$ may escape each other because of the slots formed 26' to $\mathbf{26}^{IV}$ therebetween and the channelled lines 23' to $\mathbf{23}^{IV}$.

The "retraction" of areas of the fork-shaped end portions into the interior of the bottle carrier makes it possible to remove the (further) strip-shaped central portion 15, 21 from the bottles by such a distance that they will not interfere with carrying. In addition, this achieves a favourable transfer of forces from the handle portion 14 into the further side walls.

In contrast to the cut-to-size piece 1', the cut-to-size piece 1" has pull-up tabs 27', 28' in the side walls 3,5 that are torn open from top and do not have any gripping tab at bottom.

Figure 2:
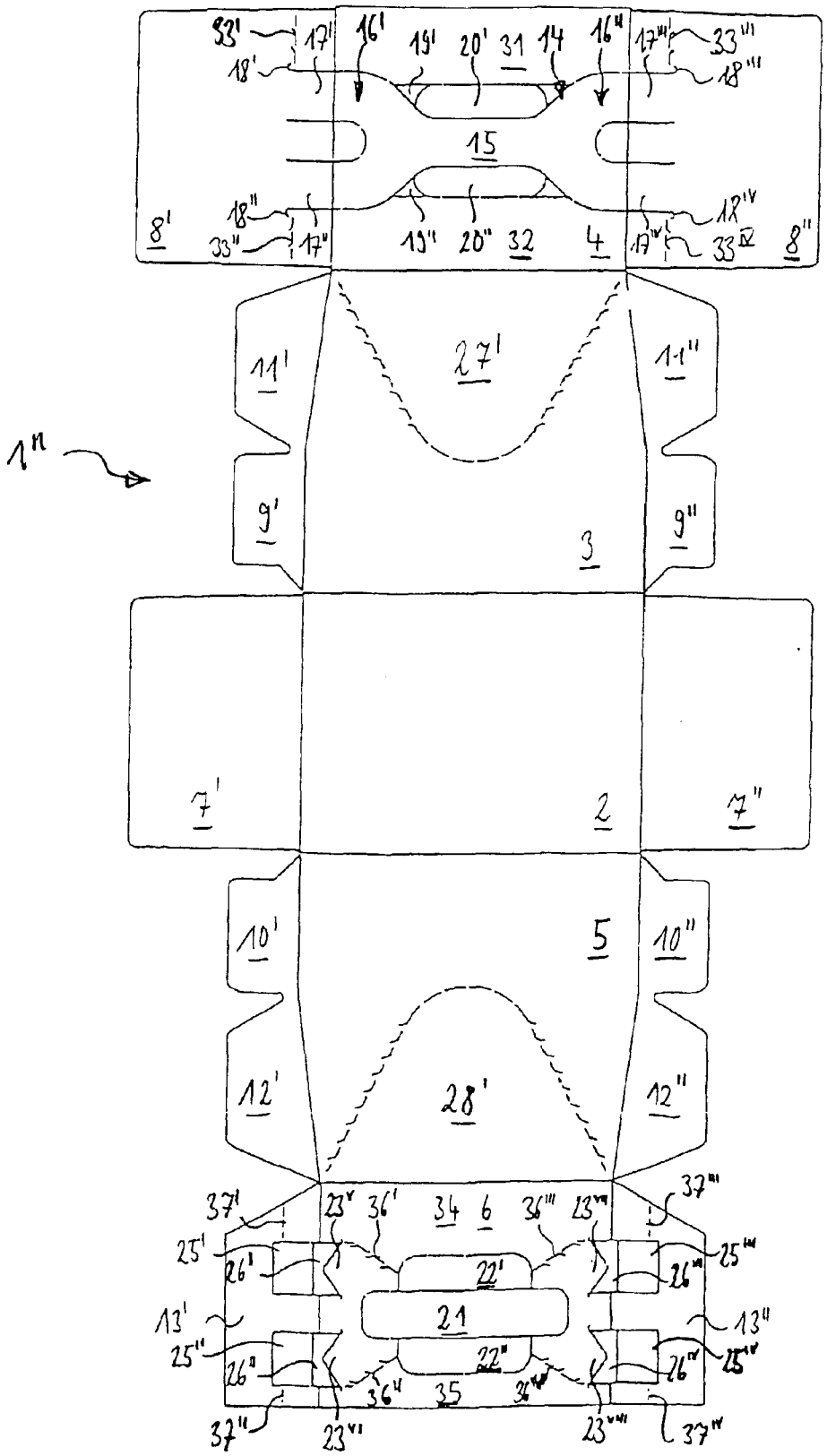
FIG. 2 shows a cut-to-size piece for a bottle carrier having upper and lateral pull-up tabs as flatly spread out in a plan view.
Figure 3:
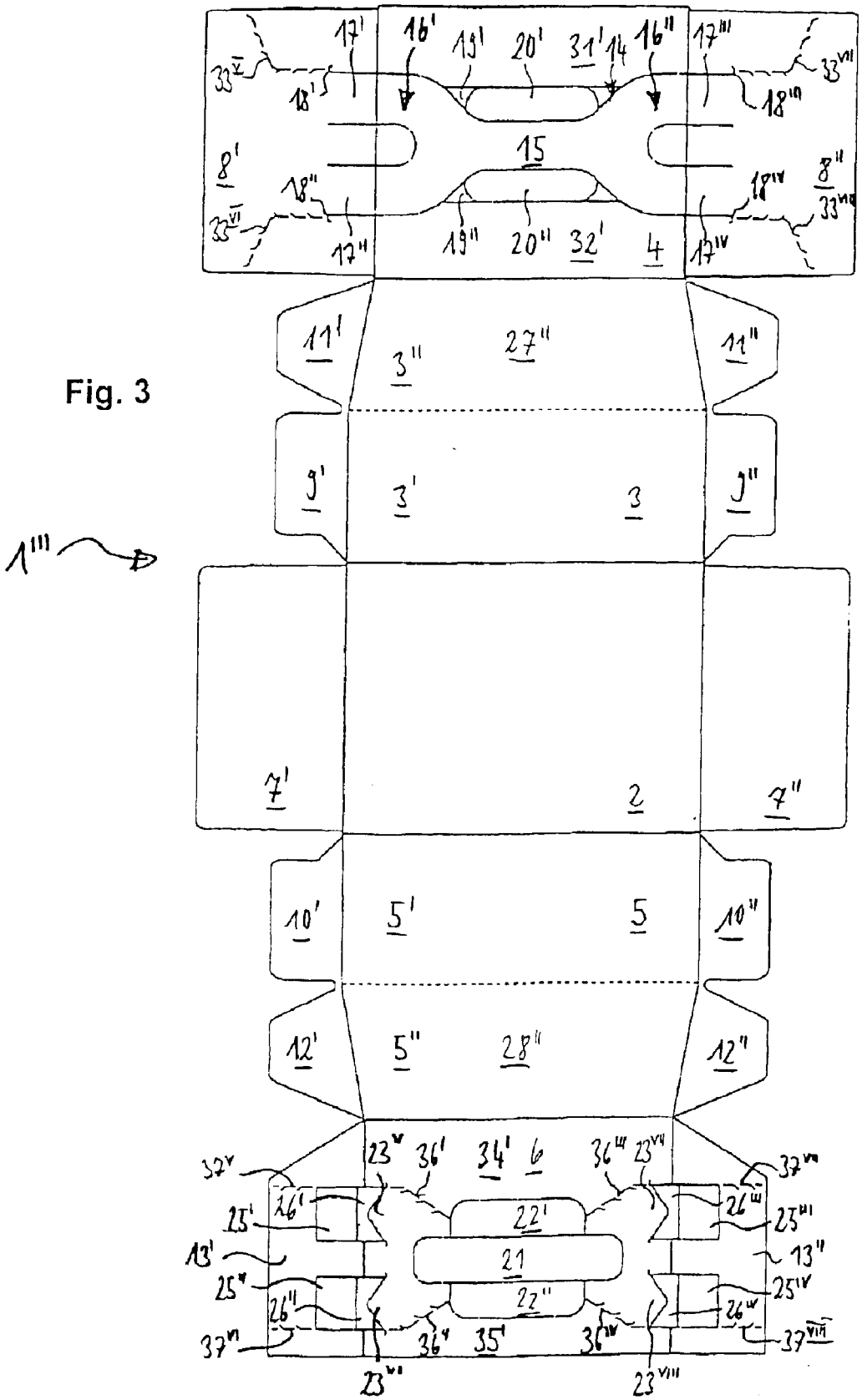
FIG. 3 shows a cut-to-size piece for a bottle carrier having modified upper and lateral pull-up tabs as flatly spread out in a plan view.

The embodiment of FIG. 2 is of advantage particularly for long-neck bottles. Here, the parabolic pull-up tabs 27', 28' still achieve sufficient stability even after bring opened, which allows to carry reinserted bottles.

In addition, the top wall 4 and the side wall elements 8', 8" have upper pull-up tabs 31, 32 which are arranged on either side of handle portion 14. They are defined by punched lines which externally define the punched-out portions 19', 19" and the fork-shaped end portions 17' to $\mathbf{17}^{IV}$. Further, straight-lined weakening lines run from the filletings 18' to $\mathbf{18}^{IV}$ in the side wall elements 8', 8" to the lateral borders of the side wall elements 8', 8".

As a particularity, the further top wall 6 has four reversing tabs $\mathbf{23}^{V}$ to $\mathbf{23}^{VIII}$ which are tapered towards the side flaps 13', 13" in the shape of an arrow tip.

On either side of the further central portion 21, the further top wall 6 and the side flaps 13', 13" have located therein further upper pull-up tabs 34, 35. Those are defined by further pull-up lines 36' to $\mathbf{36}^{IV}$ which extend from the narrow ends of rectangular tabs 22', 22" to the outer borders of reversing tabs $\mathbf{23}^{V}$ to $\mathbf{23}^{VIII}$.

In addition, the further upper pull-up tabs 34, 35 are defined by further straight-lined weakening lines 37' to $\mathbf{37}^{IV}$ which run in the side flaps 13', 13" from the reversing tabs 25' to $\mathbf{25}^{IV}$ to the lateral borders of side flaps 13', 13".

In this cut-to-size piece I", the top wall 4 and the further top wall 6 are glued to each other in the area of the strip-shaped central portion 15 and the further strip-shaped central portion 21. Furthermore, the upper and further upper pull-up tabs 31 and 34 as well as 32 and 35 are glued to each other.

Also here, a set of bottles may be pushed through a front-sided aperture of the cut-to-size piece 1" brought into an envelope shape, in which case the reversing tabs $\mathbf{23}^{V}$ to $\mathbf{23}^{VIII}$ facing the push-in aperture, because of the taper, are raised by the bottles being pushed in if they protrude into the interior.

Then, the front-sided apertures will be closed as previously described.

For handling, the tabs 20', 20" and 22', 22" are folded under the central portions 15, 21 and are then raised together with these.

For bottle removal, the upper pull-up tabs 31, 32, along with the further upper pull-up tabs 34, 35 pasted on, are torn out starting from the punched-out portions 19, 19", at least until the weakening lines 33' to $\mathbf{34}^{IV}$ and 37' to $\mathbf{37}^{IV}$ are torn apart. The user may outwardly fold the tom-apart pull-up tabs 31, 32, 34, 35 or may even detach the pull-up tabs 27', 28" from the bottle carrier. Then, the bottles may be conveniently drawn out both at top and at the side and may be reinserted later.

The cut-to-size piece 1''' is initially distinguished from the cut-to-size piece 1' by the configuration of the pull-up tabs 27'', 28'' in the side walls 3, 5. The pull-up tabs 27'', 28'' each are defined by a straight-lined weakening line which runs between the lower side wall portion 3', 5' and the upper side wall portion 3'', 5''.

In the side wall elements 8', 8'', the upper pull-up tabs 31', 32'' are defined by weakening lines $\mathbf{33}^{V}$ to $\mathbf{33}^{VIII}$ which extend from the filletings 18' to $\mathbf{18}^{IV}$ and initially run in parallel with the borders of the side wall elements 8', 8'' and are then angled towards the borders.

In the side flaps 13', 13'', the further upper pull-up tabs 34', 35' are defined straight-lined weakening lines $\mathbf{37}^{V}$ to $\mathbf{37}^{VIII}$ which come to terminate towards the ends of the side flaps 13', 13''.

The top wall 4 and the further top wall 6 are glued to each other in the area of the central portion 15 and the further central wall portion 21 and in the area of the upper and further pull-up tabs 31' and 34' as well as 32' and 35'.

For opening, the upper pull-up tabs 31', 34', 32', 35' are torn out starting from the punched-out portions 19', 19'', at least until the weakening lines $\mathbf{33}^{V}$ to $\mathbf{33}^{VIII}$ and $\mathbf{37}^{V}$ to $\mathbf{33}^{VIII}$ are torn apart. The pull-up tabs 27'', 28'' may also be tom out in addition afterwards.

Figure 4:
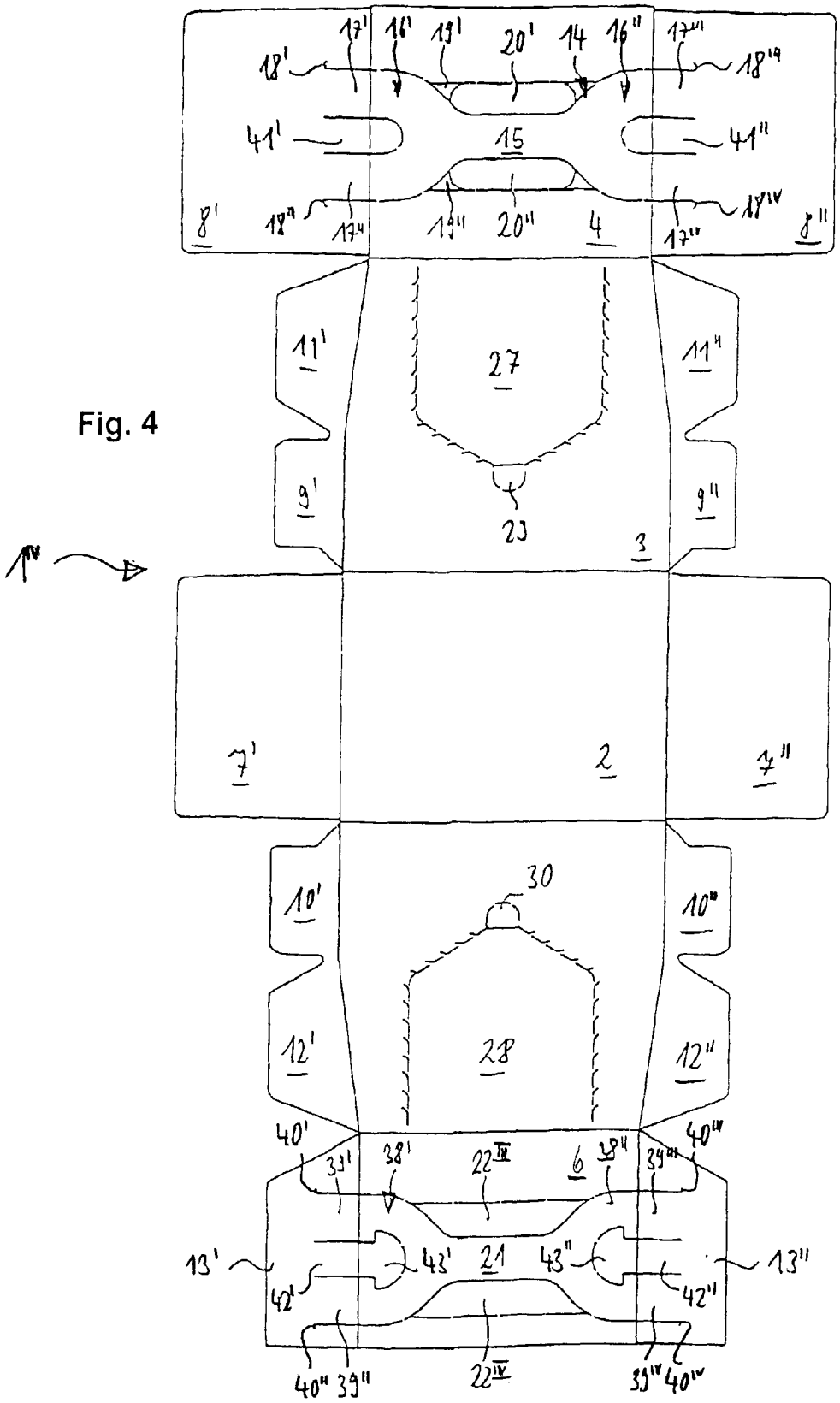
FIG. 4 shows a cut-to-size piece for a bottle carrier having further fork-shaped end portions as flatly spread out in a plan view.

The cut-to-size piece $\mathbf{1}^{IV}$ of FIG. 4 is distinguished from the cut-to-size piece 1' by the fact that the further central portion 21 in the further top wall 6 is joined to two further fork-shaped end portions 38', 38'' which extend to end in the side flaps 13', 13''. The further central portion 21 and the further fork-shaped end portions 38', 38'' are substantially in congruence with the central portion 21 and the fork-shaped end portions 16', 16'' of the top wall 4 or side wall elements 8', 8''.

Fork prongs 39' to $\mathbf{39}^{IV}$ of the punched lines defining the fork-shaped end portions 38', 38'' extend to terminate in filletings 40' to $\mathbf{40}^{IV}$ in the side flaps 13', 13''.

Fork prongs 17' to $\mathbf{17}^{IV}$ have located therebetween intermediate tabs 41, 41'' which extend from the side wall elements 8', 8'' to terminate in the top wall 4.

Fork prongs 39' to $\mathbf{39}^{IV}$ have located therebetween further intermediate tabs 42', 42'' which extend from the side flaps 13', 13'' to terminate in the further top wall 6. They have a mushroom head-shaped widenings 43', 43'' each within the further top wall 6.

Large punched-out portions or flaps 22''', $\mathbf{22}^{IV}$ are located on either side of the further central portion 21.

In a bottle carrier formed by the cut-to-size piece $\mathbf{1}^{IV}$, the central portions 15, 21 and the fork-shaped end portions 16', 38' and 16'', 38'' are glued to each other. Furthermore, each intermediate tab 41', 41'' is glued to a further intermediate tab 42', 42''.

When the central portions 15, 21 are raised the fork-shaped end portions 16', 38' and 16'', 38'' penetrate into the intermediate areas between the bottles. The outer portions of fork-shaped end portions 38', 38'' are pushed over the mushroom head-shaped widenings 43', 43'', retaining the further intermediate tabs 42', 42'' and the intermediate tabs 41', 41'' on the upper surfaces of the bottles.

Figure 5:
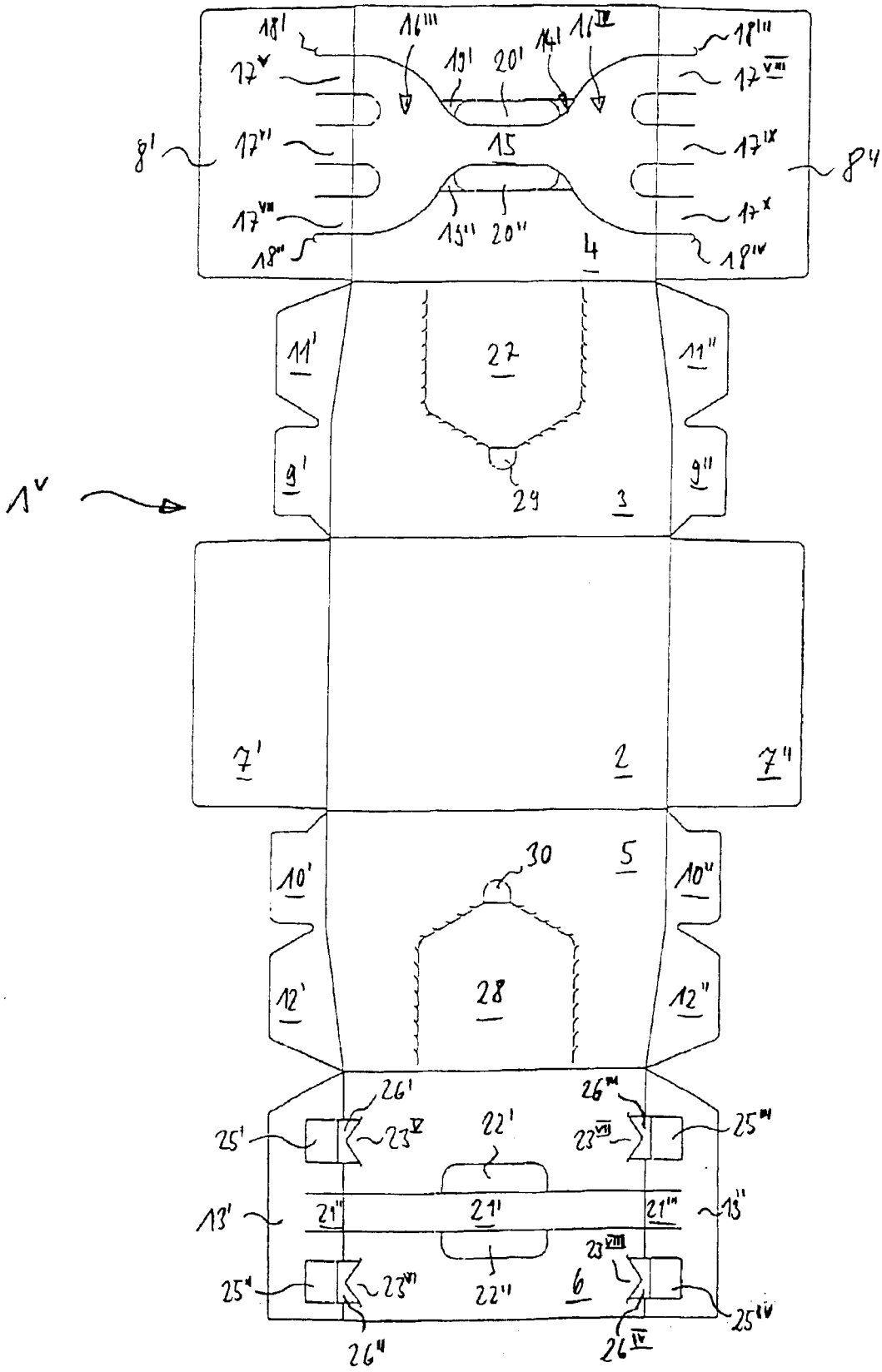
FIG. 5 shows a cut-to-size piece for a bottle carrier having fork-shaped end portions with three fork prongs and a central portion extending into the side flaps as flatly spread out in a plan view.

In contrast to the cut-to-size piece $\mathbf{1}^{V}$ of FIG. 5, the cut-to-size piece 1' has a handle portion 14' including fork-shaped end portions 16''', $\mathbf{16}^{IV}$ which have three fork prongs $\mathbf{17}^{V}$ to $\mathbf{17}^{X}$ each. The punched lines externally defining the fork prongs $\mathbf{17}^{V}$, $\mathbf{17}^{VII}$, $\mathbf{17}^{VIII}$, and $\mathbf{17}^{X}$ have a filleting 18' to $\mathbf{18}^{IV}$ each.

Furthermore, the further strip-shaped central portion 21' in the further top wall 6 has strip-shaped end portions 21'', 21''' which come to terminate in the side flaps 13', 13''. The reversing tabs $\mathbf{23}^{V}$ to $\mathbf{23}^{VIII}$ and 25' to $\mathbf{25}^{IV}$ are designed as for the cut-to-size pieces 1' and 1'''.

A bottle carrier formed from the cut-to-size piece $\mathbf{1}^{V}$ is capable of accommodating four times five bottles. The strip-shaped central portions 15 and 21' are glued to each other and so are the fork prongs $\mathbf{17}^{VI}$ and $\mathbf{17}^{IX}$ to the strip-shaped end portions 21'', 21'''.

For carrying, the tabs 20', 20'' and 22', 22'' are folded down on either side of the strip-shaped central portions 25, 21' and are raised, along with the strip-shaped central portions 25, 21'. At this stage, the fork prongs $\mathbf{16}^{III}$, $\mathbf{16}^{IV}$, and the strip-shaped end portions 21'', 21''' penetrate into the vacant spaces next to the two middle bottles of the two outer rows of bottles.

The handle portion 14' of the bottle carrier made from the cut-to-size piece $\mathbf{1}^{IV}$ is specifically protected against being tom off due to torsional loads.

Figure 6:
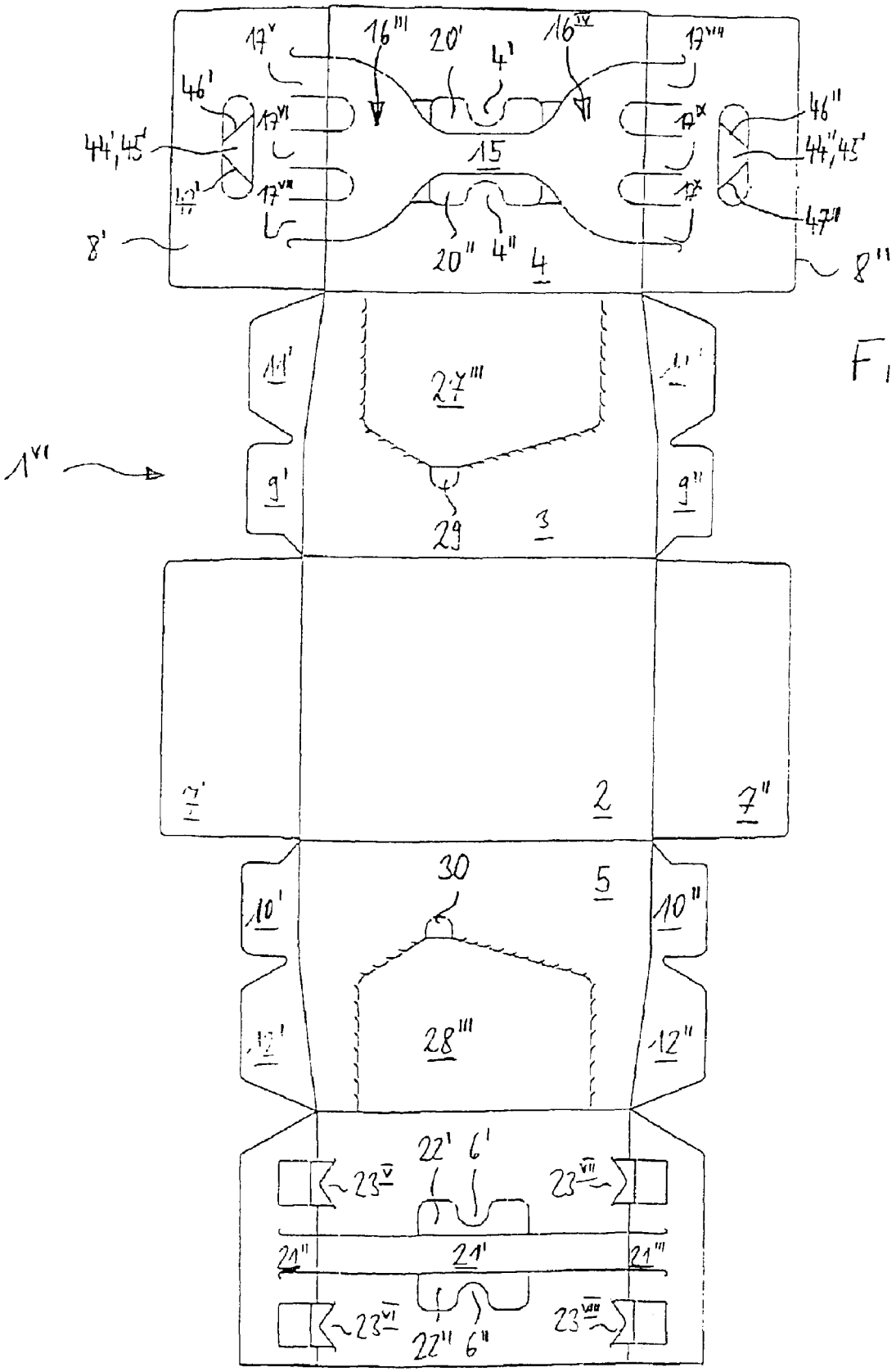
FIG. 6 shows a cut-to-size piece for a bottle carrier having fork-shaped end portions with three fork prongs and gripping holes in the side walls as flatly spread out in a plan view.

In contrast to the cut-to-size piece $\mathbf{1}^{V}$, the cut-to-size piece $\mathbf{1}^{IV}$ of FIG. 6 has ovally designed handle apertures 44', 44'' in the side wall elements 8', 8''. The handle apertures 44', 44'' have located therein gripping tabs 45', 45'' each, which are hinged at top, i.e. to the border of the handle apertures 44', 44'' that is adjacent to the fork prongs $\mathbf{17}^{V}$ to $\mathbf{17}^{X}$.

The gripping tabs 45', 45'' each have two straight folding lines 46', 47', 46'', 47'' which run from the upper border to the lower border of the handle apertures 44', 44'' and approach each other in this direction. These allow to fold the gripping tabs 45', 45'' in between the middle bottles of the outer rows, in which case the outer gripping tab portions, when contacting the bottle necks, swivel inwards and can swivel out again after them.

Further, the particularity of the cut-to-size piece $\mathbf{1}^{V}$ is that they have bulges 4', 4'' and 6', 6'' in the top wall 4 and the further top wall 6 adjacent to the tabs 20', 20'' and 22', 22'', which bulges cover the upper areas of bottles located underneath. This makes it easier to swivel the tabs 20', 20'' and 22', 22'' downwards between the covered bottles in order to raise the strip-shaped central portions 15, 21'.

Finally, the particularity of the cut-to-size piece $\mathbf{1}^{V}$ is that it has asymmetrically formed pull-up tabs 27''', 28'''. The gripping tabs 29, 30 thereof are arranged so as to allow themselves to be forced into the intermediate areas between two bottles, which makes it easier to tear open the pull-up tabs 27''', 28'''.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A bottle carrier made of a foldable flat material, particularly cardboard, comprising:

a top wall (4), a bottom wall (2), side walls (3, 5, 7, 8) interconnecting the top wall (4) and bottom wall (2) at the sides, and a handle portion (14) extending across the top wall (4) and into two opposed side walls (7, 8) which is defined by weakening lines in the top wall (4) and the side walls (7, 8), has a strip-shaped central portion (15) in the top wall (4) and two fork-shaped end portions (16', 16") each of which extends into an adjoining side wall (7, 8) from the top wall and is joined to the side wall (7, 8) at the outer ends;

wherein the ton wall (4) has disposed thereunder a further top wall (6) which has a strip-shaped central portion (21) defined by weakening lines which is disposed below the strip-shaped central portion (15) of the top wall (4) so that the strip-shaped central portion (15) and the further strip-shaped central portion (21) are adapted to be raised together wherein handle apertures (19, 22) to insert a hand are located on either side of the strip-shaped central portion (15) and/or the further strip-shaped central portion (21);

wherein the further top wall (6), at opposed sides, has hinged thereto side flaps (13', 13") which are disposed at the insides of the side walls (7, 8) to which the fork-shaped end portions (16', 16") are joined at their end sides;

wherein the further strip-shaped central portion (21) has two further fork-shaped end portions (38', 38") each of which extends into the adjoining side flap (13', 13") from the further top wall (6) and is joined to the side flap (13', 13") at the outer ends;

wherein top wall (4) and further top wall (6) are nearly congruent and the entire top wall (4,6) consists of not more than two superimposed cardboard layers, and wherein the entire handle portion (14) and central portion (21) and form-shaped end portions (38', 38") do not comprise more than two superimposed carton layers.

2. The bottle carrier according to claim 1 wherein the fork-shaped end portions (16', 16") each have two fork prongs (17' to $\mathbf{17}^{IV}$).

3. The bottle carrier according to claim 1 wherein the fork-shaped end portions ($\mathbf{16}^{III}$, $\mathbf{16}^{IV}$) each have three fork prongs ($\mathbf{17}^{V}$ to $\mathbf{17}^{X}$).

4. The bottle carrier according to claim 1 wherein at least the weakening lines externally defining the handle portion (14) in the side walls (7, 8) end in filletings (18' to $\mathbf{18}^{IV}$) bent away from the handle portion (14).

5. The bottle carrier according to claim 1 wherein the further strip-shaped central portion (21) is completely defined by a weakening line and is joined to the strip-shaped central portion (15).

6. The bottle carrier according to claim 1 wherein the strip-shaped central portion (15) and/or the further strip-shaped central portion (21) have tabs (20, 22) disposed alongside in the handle apertures (19, 22) which are adapted to be folded under the strip-shaped central portion (15) and/or the further strip-shaped central portion (21).

7. The bottle carrier according to claim 1 wherein the further top wall (6) and/or the side flaps (13', 13"), adjacent to the borders of the further top wall (6) that adjoin the side walls (7, 8) to which the fork-shaped end portions (16', 16") are joined at their end sides, have disposed therein reversing flaps (23' to $\mathbf{23}^{IV}$; 25' to $\mathbf{25}^{IV}$) defined by punched-out portions which are disposed below the fork prongs (17' to $\mathbf{17}^{IV}$) so that if the central portion (15) is raised the fork prongs (17' to $\mathbf{17}^{IV}$) are reversed by the reversing flaps (23' to $\mathbf{23}^{IV}$; 25' to $\mathbf{25}^{IV}$) in an approximately curved fashion.

8. The bottle carrier according to claim 7 wherein at least one reversing flap (23' to $\mathbf{23}^{IV}$) has at last one channelled line (23', 24") oriented transversely to the fork prongs.

9. The bottle carrier according to claim 7 wherein reversing flaps ($\mathbf{23}^{V}$ to $\mathbf{23}^{VIII}$) disposed in the further top wall (6) are tapered towards the side flaps ($\mathbf{13}^{III}$, $\mathbf{13}^{IV}$).

10. The bottle carrier according to claim 2 wherein the further fork-shaped end portions (38', 38") each have two fork prongs (39' to $\mathbf{39}^{IV}$).

11. The bottle carrier according to claim 10 wherein intermediate tabs (41', 41") disposed between the fork prongs (17' to $\mathbf{17}^{IV}$) are joined to further intermediate tabs (42', 42") disposed between the fork prong (39' to $\mathbf{39}^{IV}$) which have a widened portion (43', 43") within the further top wall (6).

12. The bottle carrier according to claim 3, win the further strip-shaped central portion (21') has strip-shaped end portions (21", 21'") each of which extends into the adjoining side flap (13', 13") from the further top wall (6) and is joined to the side flap (13', 13") at the outer ends.

13. The bottle carrier according to claim 7 wherein the strip-shaped central portion (15') and the further strip-shaped central portion (21') are joined to each other.

14. The bottle carrier according to claim 13 wherein the top wall (4) and the further top wall (6) are connected to each other in the areas outside the reversing portions (23' to $\mathbf{23}^{IV}$) and the fork-shaped end portions (16', 16").

15. The bottle carrier according to claim 1 wherein pull-up tabs (27, 28) which are defined by weakening lines and are extended approximately up to the top wall are located in two opposed side walls (3, 5).

16. The bottle carrier according to claim 15 wherein each tear tab (27, 28) has a hinged joint in the vicinity of the top wall (4) and is defined by two weakening lines led away approximately in parallel from the hinged joint which are joined to each other at a spacing from the top wall.

17. The bottle carrier according to claim 15 wherein the weakening lines defining the pull-up tabs (27, 28) meet together at a deep point of the pull-up tabs (27, 28) that forms a short gripping tab (29, 30).

18. The bottle carrier according to claim 15 wherein the pull-up tabs (27, 28) are disposed in the longitudinal walls (3, 5) which are disposed on the longitudinal sides of the handle portion (14).

19. The bottle carrier according to claim 1 wherein further pull-up tabs (34, 35) which are defined by weakening lines on either side of the handle portion (15) and are extended up to borders of the side walls (8', 8") and the side flaps (13', 13") are located in the top wall (4), the side walls (8', 8") to which the fork-shaped end portions (16', 16") are joined, the further top wall (6), and the side flops (8', 8").

20. The bottle carrier according to claim 1 comprising a cut-to-size piece (1) of a foldable flat material that has a bottom wall (2), side walls (25) hinged to the longitudinal sides of the bottom wall (2), a top wall (4) hinged to a further longitudinal side of a side wall (3), and a further top wall (6) hinged to a further longitudinal side of a further side wall (5).

21. The bottle carrier according to claim 1 wherein the bottom wall (2) and the top wall (6) have side wall elements hinged to the transverse sides (7', 7"; 8', 8") that can be folded towards each other and are connected to each other.

22. The bottle carrier according to claim 21 wherein the side wall elements (7', 7"; 8', 8") have folded thereunder side flaps (10', 10" to 12', 12") which are hinged to the ease sides of adjoining side walls (3, 5).

23. The bottle carrier according to claim 1 wherein at least two opposed side walls (3, 5) have a rectangular portion (3', 5') adjoining the bottom wall (2) and one trapezoidal portion (3", 5") adjoining the top wall (2).

24. The bottle carrier according to claim 1 wherein gripping holes (44', 44") arm disposed in at least two opposed side walls (7, 8).

25. The bottle carrier according to claim 24 wherein the gripping holes (44', 44") are disposed in the side walls (7, 8) to which the fork-shaped end portions (16', 16") are joined at the end sides.

26. The bottle carrier according to claim 25 wherein the gripping holes (44', 44") are reinforced by the side flaps (13', 13").

27. The bottle carrier according to claim 24 wherein gripping tabs (45', 45") are disposed in the gripping holes (44', 44").

* * * * *